US005735212A

United States Patent [19]

Oyaizu

[11] Patent Number: 5,735,212

[45] Date of Patent: Apr. 7, 1998

[54] CYLINDER CLEANING APPARATUS

[75] Inventor: Hideo Oyaizu, Tokyo, Japan

[73] Assignee: Baldwin-Japan Ltd., Tokyo, Japan

[21] Appl. No.: 510,782

[22] Filed: Aug. 3, 1995

[30] Foreign Application Priority Data

Aug. 9, 1994 [JP] Japan ..... 6-207981

[51] Int. Cl.[6] ..... B41F 35/00

[52] U.S. Cl. ..... 101/423; 101/425

[58] Field of Search ..... 101/423, 425, 101/424

[56] References Cited

U.S. PATENT DOCUMENTS

| | | | |
|---|---|---|---|
| 4,058,059 | 11/1977 | Moestue | 101/425 |
| 5,105,740 | 4/1992 | Loos et al. | 101/425 |
| 5,150,650 | 9/1992 | Murakami | 101/425 |
| 5,150,653 | 9/1992 | Hara | 101/425 |
| 5,325,779 | 7/1994 | Ebina | 101/423 |
| 5,479,857 | 1/1996 | Braun | 101/423 |

*Primary Examiner*—Edgar S. Burr
*Assistant Examiner*—Anthony H. Nguyen
*Attorney, Agent, or Firm*—Morgan & Finnegan, L.L.P.

[57] ABSTRACT

A cylinder cleaning apparatus expected to clean an external surface of cylinder by using a cleaning cloth which is fed from a cloth feed roll and expanded between the cloth feed roll and a corresponding cloth wind shaft. The apparatus is characterized to have a first axis driving the cloth feed roll to supply the cleaning cloth, a second axis driving the cloth wind shaft to wind the supplied cleaning cloth, and a power generation means for generating a rotation power for rewinding the first axis and winding the second axis in conformity with a displacement degree of a cloth feed arm swung by an actuator; and a shift means for selectively transmit the rotation power by the power generation means to the first axis or second axis.

11 Claims, 9 Drawing Sheets

CYLINDER CLEANING APPARATUS

BACKGROUND OF THE INVENTION

1. Field of the Invention

This invention is broadly concerned with a cylinder cleaning apparatus for removing blot on a blanket cylinder and an impression cylinder in a printing machine or on cylinders and rollers in a machine for processing various kinds of papers and films such as a paper making machine.

2. Description of the Related Art

A peripheral surface of cylinder is generally expected to be kept clean not to spoil an object to be processed. Supposing a blanket cylinder in a printing machine, it may be smudged with ink remained thereon as time passes. Accordingly, there have been developed some cylinder cleaning apparatus to keep clean surface of the blanket.

In a general conventional cylinder cleaning apparatus, there are provided shafts for a cloth feed roll and a corresponding cloth wind shaft on a pair of side plates in a state parallel to a central axis of the cylinder. These shafts are wound thereon with a web-like cleaning cloth with a certain tension. Behind the cleaning cloth lying between the cloth feed roll and the cloth wind shaft, there is provided a cloth urging device having a pad or pressure roller for urging the cleaning cloth on a surface of the cylinder.

The cloth wind shaft in the above mentioned cylinder cleaning apparatus is driven by a drive unit continuously at a certain speed or intermittently. The cloth urging device having the pad or the like is also activated to urge the cleaning cloth on the surface of the cylinder to wipe blot.

A second axis of the cloth wind shaft is generally driven by an electric motor with reduction gears rotating constantly in a normal direction, otherwise by an air cylinder or linear actuator activating reciprocally in association with a lever or ratchet system to provide a rotational movement for the second axis. In the cleaning operation, the cleaning cloth is intermittently and continuously fed to wipe blot on the cylinder. The cleaning cloth is soiled terribly at the first stage and the soiled degree gradually becomes slight. Such slightly soiled cleaning cloth can be reused for the next cleaning work by rewinding them as to be a cloth feed roll, which will contribute effective use of natural resources.

By the way, after cleaning procedure, there has been proposed a cylinder cleaning apparatus in combination with a wind system for restoring a part of the used cleaning cloth. According to, for example, the Japanese Patent Publication No. Sho 56-32069, it is provided with a manual control cloth rewind mechanism to manually rewind the cleaning cloth once fed from the cloth feed roll. According to the Japanese Patent Publication No. Hei 4-64509 and the Japanese Patent Laid-open No. Hei 1-122437, they disclose an automatic cloth rewind mechanism, in which a driving device such as motor is provided to reverse the cloth feed roll when completing the cleaning process.

However, it has been known that the conventional cylinder cleaning apparatus employing such automatic cloth rewind mechanism always requires to have a complicated driving system and an expensive control device for it. Accordingly, an installation space for the apparatus becomes relatively large.

Accordingly, it is an object of the present invention to provide a cylinder cleaning apparatus in which a rewind mechanism for used cleaning cloth is simplified to save consumption of cleaning cloth as much as possible.

SUMMARY OF THE INVENTION

The invention according to the present application is such that a cylinder cleaning apparatus for cleaning an external surface of cylinder by a cleaning cloth which is fed from a cloth feed roll and expanded between the cloth feed roll and a corresponding cloth wind shaft, the cylinder cleaning apparatus having: a first axis driving the cloth feed roll to supply the cleaning cloth; a second axis driving the cloth wind shaft to wind the supplied cleaning cloth; power generation means for generating a rotation power for rewinding the first axis and winding the second axis in conformity with a displacement degree of a cloth feed arm swung by an actuator; and shift means for selectively transmit the rotation power by the power generation means to the first axis or the second axis.

The preferable mode of the present invention may be as follows:

(1) The power generation means is consisting of a first axis gear transmitting a rotation power to rewind the cleaning cloth to the first axis, a second axis gear applying a rotation power to wind the cleaning cloth to the second axis, and gear transmitting means for transmitting a movement of the cloth feed arm to the first axis gear or the second axis gear.

(2) The power generation means can be defined by a first axis gear applying a rotation power to the first axis to rewind the cleaning cloth, a second axis gear applying a rotation power to the second axis to wind the cleaning cloth, and gear transmitting means for transmitting a movement of the cloth feed arm to the first axis gear or the second axis gear; and wherein the shift means is defined by a wind and rewind shift gear selectively engaging with the first axis gear or the second axis gear, a shift gear shaft supported on the cloth feed arm in a state not to rotate but movable in an axial direction, and a wind and rewind actuator shifting the shift gear shaft supported on the cloth feed arm to one of two positions for winding and rewinding.

(3) The shift means can be defined by a one-way clutch to allow one direction power transmission between the second axis gear and the second axis, a one-way clutch to allow one direction power transmission between the first axis gear and the first axis, and a one-way clutch to allow one direction power transmission between a wind and rewind shift gear and a shift gear shaft.

(4) The cloth feed arm is rotatably provided on the same shaft as wind gear shaft.

(5) The gear transmitting means is rotatably arranged on the same shaft as the second axis gear and provided with an intermediate gear continuously meshing with the first axis gear to transmit the movement of the cloth feed arm to the first axis gear via the intermediate gear.

(6) It may be further provided with a predetermined length cloth-feed system controlling a displacement degree of the cloth feed arm in conformity with an amount of cloth wound around the first axis or the second axis.

(7) The predetermined length cloth feed system can be defined by cloth diameter detection means for sensing a diameter of the first axis or the second axis, an arm regulation member to limit a displacement degree of the cloth feed arm in conformity with the cloth diameter sensed by the cloth roll diameter detection means, a predetermined feed control member having a wind regulation surface and a rewind regulation surface to control a displacement degree of the cloth feed arm, and a predetermined length shift actuator to control the arm regulation member with reference to the wind regulation surface or the rewind regulation surface.

(8) The wind and rewind shift gear is recommended to be processed to have tapered cut-off portions at their teeth, and wherein the second axis gear and the first axis gear meshing with the wind and rewind shift gear are also processed to have tapered cut-off portions at contacting portions.

(9) The intermediate gear is recommended to be processed to have tapered cut-off portions at contacting portions with the wind and rewind shift gear.

Accordingly, in the cloth feed operation through the cleaning operation, the shift means is shifted to the second axis side. If the cloth feed arm is operated by the cloth feed actuator, the power generation means generates a wind power for the second axis in conformity with the displacement degree of the cloth feed arm to thereby rotate the second axis so as to feed the cleaning cloth. When operating the cloth feed actuator by switching the shift means to the first axis side after completing the cleaning procedure, the power generation means effects the rewind power to the first axis so as to rotate, whereby the used cleaning cloth wound around the cloth wind shaft is rewound by the predetermined length. The rewound cleaning cloth is prepared for the next cleaning procedure. The selected first axis or second axis is rotated by an operation of the cloth feed arm, so that the whole mechanism can be simplified and the scale is resulted in small in size, whereby the present invention can be appreciated in view of the cost.

The drive mechanism for the second axis and the first axis is organized by an combination of gears and clutches, the required power for rotating these shafts is generated in conformity with the displacement degree of the cloth feed arm, and the, shift gear is selectively shifted to the second axis gear or the first axis gear to transmit the power, so that the torque in the wind operation of the cleaning cloth can be divided into the shift gear and the second axis gear. In the rewind operation of the cleaning cloth, the torque is divided into the shift gear and the first axis gear. As the torque can be divided to gears other than the shift gear, the shift gear can be made small in size to thereby make the apparatus small.

The predetermined length cloth feed mechanism assures a precise control for feeding the necessary cleaning cloth every cleaning operation even if the cloth diameter of the cloth wind shaft or the feed roll is changed. The same structure is utilized for rewinding the used cleaning cloth, so that the control for the rewind degree can be carried out simply and correctly.

The wind regulation surface and a rewind regulation surface can be used selectively to change the displacement degree of the cloth feed arm provided to the predetermined length cloth feed mechanism. Accordingly, the constant cloth feed operation can be carried out even if the cloth diameters between the cloth wind shaft and the feed roll are different, whereby the simple rewind mechanism can be obtained and total minimization can be achieved.

DETAILED DESCRIPTION OF THE PREFERRED EMBODIMENT(S)

Figure 1:
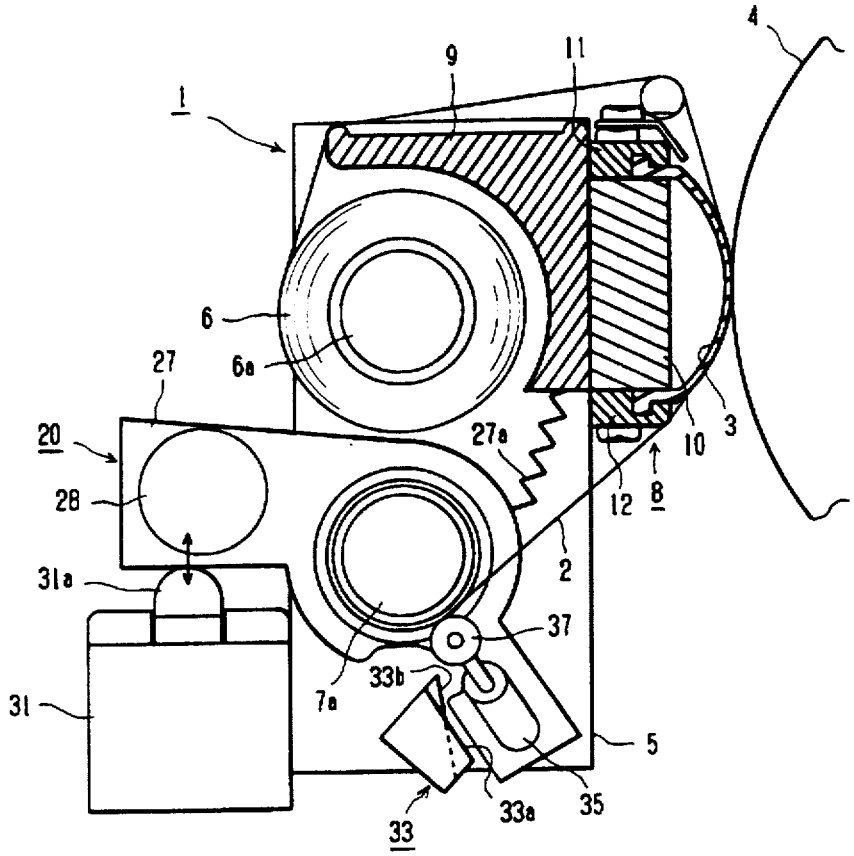
FIG. 1 is an side view of a cylinder cleaning apparatus excluding a gear and clutch mechanism according to the present invention.

The preferred embodiment of the present invention will now be described with reference to the drawings. FIG. 1 shows a fragmentary view of the embodiment according to the present invention.

A cleaning unit 1 should be understood as to be supported on a main frame. The cleaning unit 1 is provided with an air pad 3 which is made from an elastic material such as rubber and can be inflated or deflated by an air fed from an air source not-shown in the drawing. When the air pad 3 is inflated, a cleaning cloth 2 is adapted to be urged on a surface of a cylinder 4 such as the blanket cylinder to be cleaned. The state is continued throughout the cleaning procedure of blot such as ink grounds and paper powder. When deflated, the cleaning cloth 2 will be naturally released from the cylinder 4 to suspend the engagement.

As shown, a side plate 5 (shown as one of the pair) of the cleaning unit 1 is attached to a main frame. The side plate 5 is provided to rotatably support a first axis 6*a* of a cloth feed roll 6 (hereinafter referred to as "feed roll") to feed a web cleaning cloth 2 and a second axis 7*a* of a cloth wind shaft wound therearound with the cleaning cloth (hereinafter referred to as "cloth wind shaft 7") to wind the cleaning cloth 2.

A cloth urging device 8 for urging the cleaning cloth 2 to the surface of the cylinder 4 comprises a block 10 attached to a bracket 9 secured to the side plate 5 and an air pad 3 supported on the block 10. The air pad 3 is fixed on both longitudinal sides of the block 10 by means of fitting members 11 and 12.

On the side plate 5, there is further provided a cloth wind and rewind device 20 to selectively change drive directions either to the cloth feed roll side or the cloth wind shaft side to thereby wind or rewind the cleaning cloth. The cloth wind and rewind device 20 is defined by a cloth rewind mechanism rewinding a part of the cleaning cloth which is fed and used already in the cleaning operation to the cloth feed roll 6 and a cloth wind mechanism paying out the cleaning cloth by certain length for the cleaning operation.

Figure 2:
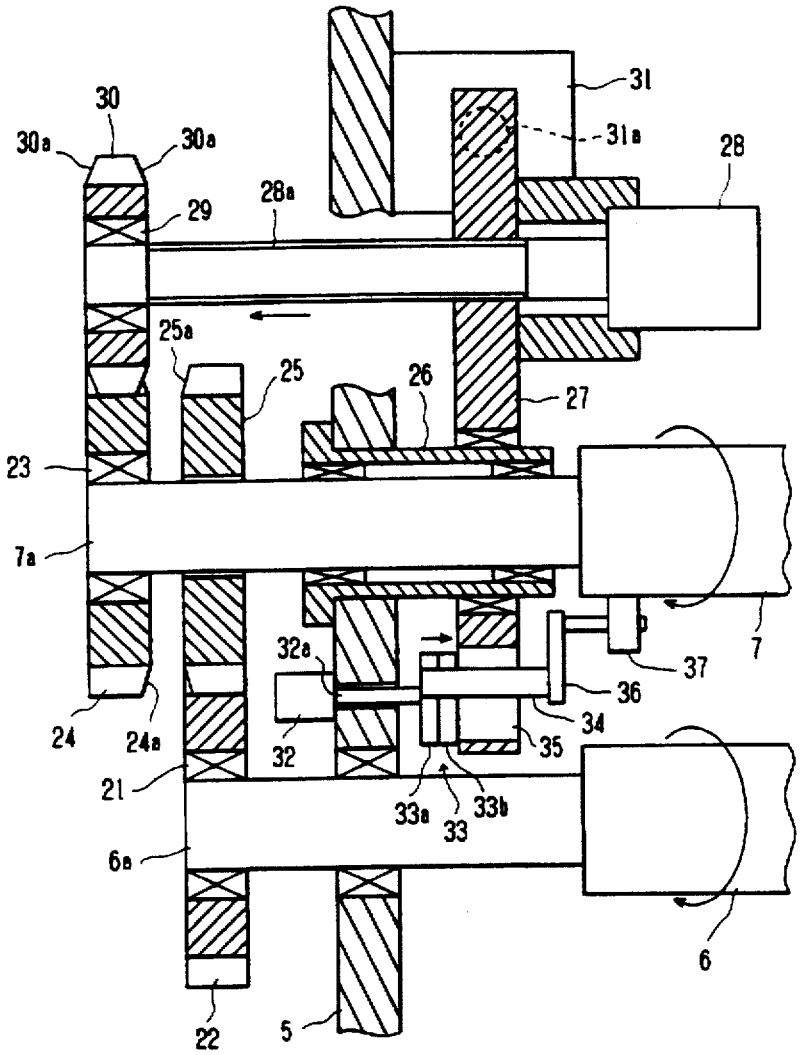
FIG. 2 is a diagrammatic view of a cloth wind and rewind device in a wind operation.
Figure 3:
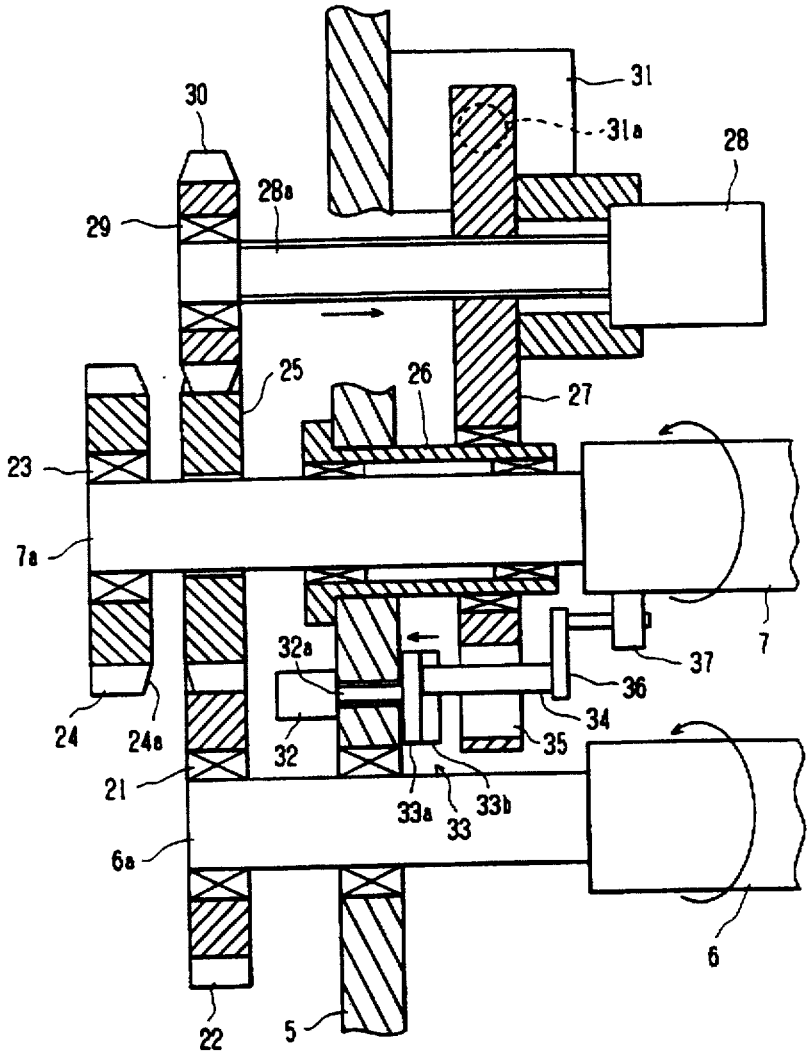
FIG. 3 is a diagrammatic view of a cloth wind and rewind device in a rewind operation.

FIGS. 2 and 3 are partially sectional views of the cloth wind and rewind device, FIG. 2 showing a wind state and FIG. 3 showing a rewind state. As can be seen, a first axis gear 22 (hereinafter referred to as "rewind gear") is coupled to at an end of the first axis 6*a* of the feed roll 6 via a clutch(A) 21 which allows a one-way drive transmission. Furthermore, at an end of the second axis 7*a* of the cloth wind shaft 7, there is provided a second axis gear 24 (hereinafter referred to as "wind gear") via a clutch(B) 23 which allows a one-way drive transmission. Between the wind gear 24 and the side plate 5 and above the second axis 7*a*, there is provided an intermediate gear 25 rotatably in a state to mesh with the rewind gear 22. More particularly, the intermediate gear 25 only effects to transmit the drive force to the rewind gear 22 but it does not relate with the rotation of the second axis 7*a*.

There is provided between the side plate 5 and the cloth wind shaft 7 an arm support sleeve 26 on the same shaft as the second axis 7*a*. The arm support sleeve 26 is secured to the side plate 5 at one portion thereof, while it carries a cloth feed arm 27 rotatably thereon. The cloth feed arm 27 is provided such that it is always abutted, by means of a spring 27*a* as shown in FIG. 1, on a forward end of an operation rod 31*a* projected from a cloth feed actuator 31 which will be explained later. The cloth feed arm 27 is accompanied with an actuator 28 (hereinafter referred to as "actuator (A)") to carry out either winding or rewinding of the cleaning cloth. The actuator (A) is for example of an air cylinder or electric solenoid.

The actuator (A) is provided with a shift gear shaft 28*a* which extends to penetrate the cloth feed arm 27 and reach to the wind gear 24,the shift gear shaft 28*a* is of a spline shaft to reciprocally move until the cloth feed arm 27 but do not rotate. Accordingly, a reliable meshing state without rattlings between a wind and rewind shift gear 30 (hereinafter referred to as "shift gear") and the wind gear 24 or between the shift gear 30 and the intermediate gear 25, whereby a reliable power transmission can be obtained. Incidentally, the shift gear 30 is coupled on a forward end of the shift gear shaft 28*a* via a clutch(C) 29 which allows a one-way drive transmission.

When an ON-OFF operation for the actuator is carried out, the shift gear shaft 28*a* is shifted in an arrow direction shown either in FIG. 2 or 3. The shift gear 30 is moved the sift gear shaft 28*a* to mesh with the wind gear 24 or the intermediate gear 25 so as to transmit the drive power. The power transmission to the rewind gear 22 is achieved through the intermediate gear 25. Incidentally, the respective gears are processed as shown in the drawings to have tapered cut-off portions 24*a*, 25*a* and 30*a* at corner portions of their teeth to assure smooth meshing operation between the shift gear 30 and the wind gear 24 or the intermediate gear 25.

The operation rod 31*a* of the cloth feed actuator 31 (hereinafter referred to as "actuator (B)") is related with the cloth feed arm 27. The operation rod 31*a* effects to a portion of the cloth feed arm 27 to swing the arm 27 by a predetermined angle to carry out the wind or rewind operation. Incidentally, the actuator(B) 31 may be composed of an air cylinder.

Figure 4A:
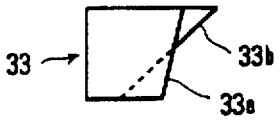
FIG. 4A is an side view of an adjuster for feeding a cleaning cloth by a predetermined length.
Figure 4B:
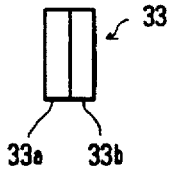
FIG. 4B is an front view of an adjuster for feeding the cleaning cloth by a predetermined length.

A side plate 5 also supports thereon a shift actuator 32 for controlling a paying out operation by a predetermined length (hereinafter referred to as "actuator (C)"). The actuator (C) is provided with an operation rod 32*a* which penetrates the side plate 5 and has an adjuster 33 for controlling a paying out operation by a predetermined length (hereinafter referred to as "adjuster") at its forward end beside the cloth feed arm 27. The adjuster 33 is defined as shown in FIG. 4 by a wind regulation surface 33*a* for the wind operation and a rewind regulation surface 33*b* for the rewind operation.

It is natural that an external diameter (cloth roll diameter) of the wound cleaning cloth around the cloth wind shaft 7 is gradually increased, so that an active control for rotation degree of the second axis 7*a* is necessary to assure the constant feeding rate of the cleaning cloth irrespective of the variation of the external diameter. While the actual wind degree or the cloth roll diameter is small, the rotation degree is made big but is decreased gradually in proportion to an increase of the cloth roll diameter.

At the same time, the external diameter of the feed roll 6 is also changed form large to small gradually in proportion to the fed degree of the cleaning cloth. When rewind the part of the cleaning cloth once wound by the cloth wind shaft 7 to the feed roll 6, it is required to rotate the first axis 6*a* in the opposite direction in conformity with a planed rewind degree. Besides, the rotation degree of the first axis should be controlled in response to its diameter in order to obtain a certain rewind degree irrespective to the change degree of the feed roll diameter. It should be noticed that there is a certain relationship between two diameters of the cloth wind shaft and the feed roll and if one diameter of them is known the other can be understood, that is, the change of diameter is in inverse proportion between the cloth wind shaft and the feed roll. Accordingly, in the present invention, the proportional control is done toward the first axis in conformity with the change degree of the cloth wind shaft diameter. In particular, the swing angle or displacement degree of the cloth feed arm is changed in proportion to the change degree of the cloth diameter by means of the adjuster 33 which has the wind regulation surface 33*a* for the wind operation and the rewind regulation surface 33*b* for the rewind operation. Accordingly, the once wound cleaning roll can be rewound to the feed roll.

As can be seen, there is provided a cloth diameter catch carrier 34 (hereinafter referred to as "carrier") as a detection means for checking an actual cloth diameter around the cloth wind shaft. The carrier 34 is adapted to be urged either on the wind regulation surface 33*a* or the rewind regulation surface 33*b* of the adjuster 33. The switch between these regulation surfaces can be carried out by shifting the adjuster along an axial direction of the carrier when the carrier does not engage with the adjuster. As shown in FIG. 2, the carrier 34 is provided to be guided by means of the long hole 35 opened in the cloth feed arm 27. The hole 35 is designed such that the carrier moves corresponding to the variation of the cloth diameter of the cloth wind shaft. The other end of the carrier 34 is connected to a cloth diameter sensing member to examine the cloth diameter of the cloth wind shaft. A cloth diameter catch roller 37 (hereinafter referred to as "roller") as the cloth diameter sensing member is provided via an arm 36.

The roller 37 is always contact with the wound cleaning cloth on the cloth wind shaft 7 and follows the variation of diameter, that is, the carrier 34 moves along the long hole 35 in response to the change of the cloth diameter. When the carrier 34 moves, the forward end of the carrier 34 is differently related with the wind regulation surface 33*a* or the rewind regulation surface 33*b* of the adjuster 33. Accordingly, when the cloth feed arm 27 swings, the swing range of the arm 27 is changed to thereby achieve a predetermined paying out of the cleaning cloth.

Figure 5A:
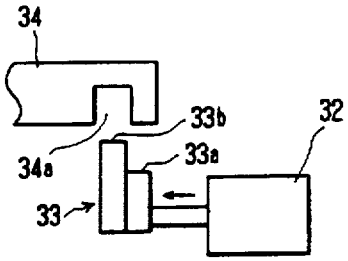
FIG. 5A is an explanatory view for a carrier separated from the adjuster in the wind operation for feeding the cleaning cloth by a predetermined length.
Figure 5B:
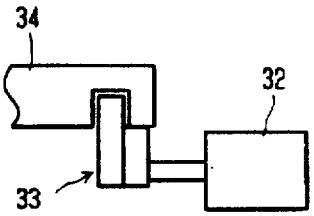
FIG. 5B is an explanatory view for a carrier abutted to the adjuster in the wind operation for feeding the cleaning cloth by a predetermined length.

The operational sequences will be explained with reference to FIGS. 5 and 6. When winding, the carrier 34 is shifted to the arrow direction in FIG. 5A by the actuator (C) to meet the rewind regulation surface 33*b* with a notch portion 34*a* of the carrier 34 and to place a forward end of the carrier at the wind regulation surface 33*a*. Accordingly, when the cloth feed arm is swung, the carrier 34 is allowed to change between a noncontacting position shown in FIG. 5A and contacting position shown in FIG. 5B. This limited movement of the carrier performs a paying out operation of the cleaning cloth by certain length.

Figure 6A:
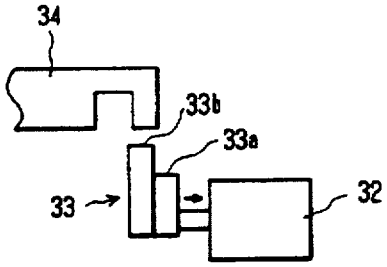
FIG. 6A is an explanatory view for a carrier separated from the adjuster in the rewind operation for feeding the cleaning cloth by a predetermined length.
Figure 6B:
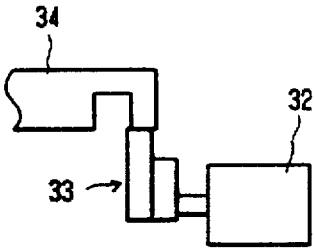
FIG. 6B is an explanatory view for a carrier abutted to the adjuster in the rewind operation for feeding the cleaning cloth by a predetermined length.

On the contrary, in the rewind operation, the carrier 34 is shifted to the arrow direction in FIG. 6A and the forward end of the carrier is placed at the rewind regulation surface 33*b*. Accordingly, when the cloth feed arm is swung, the carrier changes between the non-contacting state and the contacting state as shown in FIGS. 6A and 6B. The movement range of the carrier achieves the rewind operation by a predetermined length of the cleaning cloth in conformity with the cloth diameter.

Now referring to FIGS. 7A–7D, they shows a swing range of the cloth feed arm corresponding to the variation of the cloth diameter in the wind and rewind operations. The cloth diameter variation of the cloth wind shaft is assumed to change from $D_{S1}$ to $D_{L1}$ in the winding operation and from $D_{L2}$ to $D_{S2}$ in the rewinding operation. The cloth feed rate can be controlled by preliminary adjusting the adjuster 33 so that the swing range of the cloth feed arm is determined in conformity with the cloth diameter.

Figure 7A:
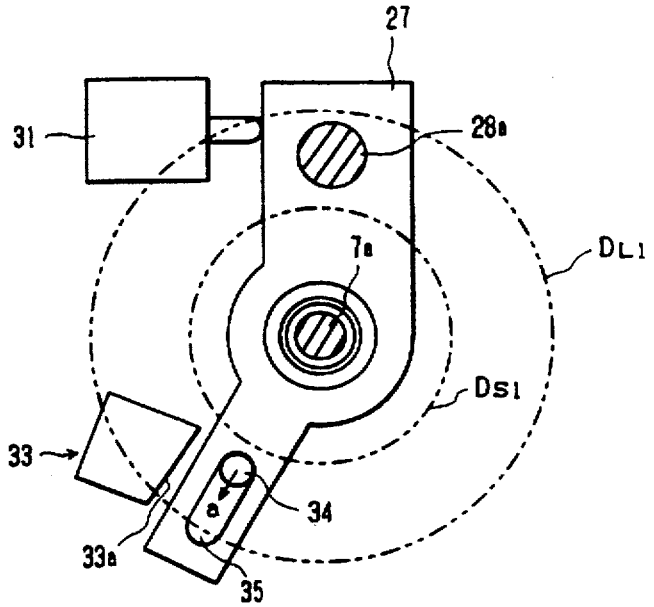
FIG. 7A is an explanatory view for a change of cloth diameter and a movement of carrier in the wind operation.
Figure 7B:
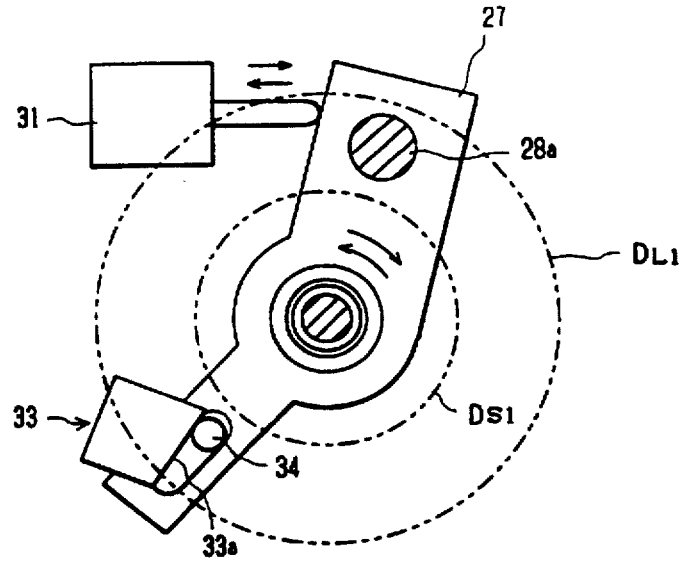
FIG. 7B is an explanatory view for a movement of a cloth feed arm in the wind operation.

When winding, the actuator 32 is operated to use the wind regulation surface 33*a* of the adjuster as shown in FIG. 7A. The actuator (A) effects an engagement of the shift gear 30 with the wind gear 24. The cloth feed cylinder 31 is operated to swing the cloth feed arm 27, whereby the rotation of the shift gear 30 is transmitted to the wind gear 24 to rotate the cloth wind shaft 7. When the used cleaning cloth around the cloth wind shaft is little and the cloth diameter is small, the carrier 34 is placed as shown in the drawing. The cloth feed arm 27 shown in FIG. 7A is swung and shifted as shown in FIG. 7B, so that the carrier 34 is moved as shown in FIG. 7B to abut to the wind regulation surface 33*a* of the adjuster. At this moment, the cloth feed arm 27 stops its movement. As the wind degree is increased and the cloth diameter becomes large, the carrier 34 is guided along the long hole 35 or moved in the arrow a direction in FIG. 7A. In accordance with the movement of the carrier 34, the interval between the carrier 34 and the wind regulation surface 33*a* or the movement distance from the state shown in FIG. 7A to that in FIG. 7B (otherwise from FIG. 7B to FIG. 7A) is made small. Therefore, the swing range of the cloth feed arm 27 is made small so that the predetermined paying out of the cleaning cloth can be performed.

Figure 7C:
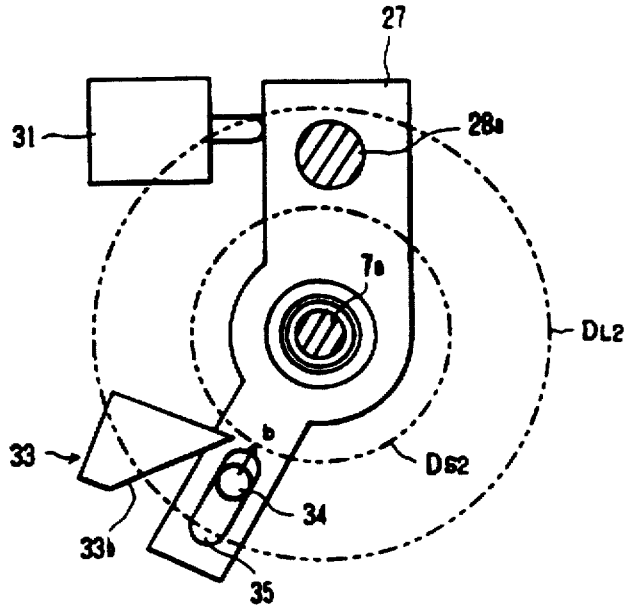
FIG. 7C is an explanatory view for a change of cloth diameter and a movement of carrier in the rewind operation.
Figure 7D:
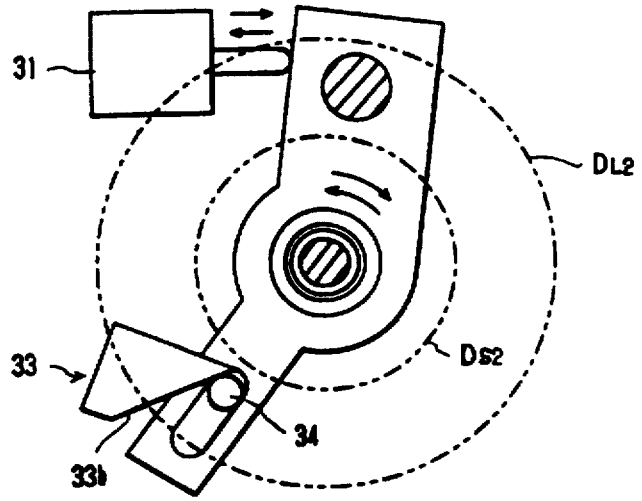
FIG. 7D is an explanatory view for a movement of the cloth feed arm in the rewind operation.

In the rewind operation, the actuator (C) is moved so as to obtain the state for the rewind regulation surface 33*b* of the adjuster 33 as shown in FIG. 7C. When the cloth diameter of the cloth wind shaft is relatively small, the cloth diameter of the feed roll is large. Accordingly, the same swing operation of the cloth feed arm as in the wind operation causes an excessive rewind volume compared with the wind volume. It is therefore necessary for the movement degree of the carrier 34 in the rewind process when the wind volume is small to be restrained compared with that in the wind procedure. As the wind degree is increased and the cloth diameter of the feed roll becomes small, the allowed movement degree of the carrier becomes large. In the rewind procedure, the cloth diameter of the cloth wind shaft is small, so that the carrier shifts in the direction b on the drawing. As the movement degree of the carrier becomes large, the predetermined feed of the cloth can be obtained. The detailed operational sequences will be explained with reference to FIG. 7D. When the operation rod of the actuator 32 is extended to swing the cloth feed arm 27 from the state shown in FIG. 7C to the arrow direction, the carrier 34 is shifted as shown in FIG. 7D and contact with the rewind regulation surface 33*b* of the adjuster. In this state, the cloth feed arm 27 is suspended. When the actuator 32 reaches its nonoperation state, the cloth feed arm 27 returns as shown in FIG. 7C. As the wind volume is increased and the cloth diameter becomes large, the carrier 34 is guided along the long hole 35 and moved in the arrow a direction. The movement of the carrier 34 causes an expansion of intervals between the carrier 34 and the rewind regulation surface 33*b*. As a result, the swing range of the cloth feed arm 27 is expanded to thereby obtain the expected rewind of the cleaning cloth by the predetermined length.

Accordingly, by regulating the swing range of the cloth feed arm in response to the external diameter of the used cleaning cloth wound on the cloth wind shaft, the expected wind and rewind operations of the cleaning cloth by the predetermined length can be achieved irrespective to the cloth diameter.

Figure 8A:
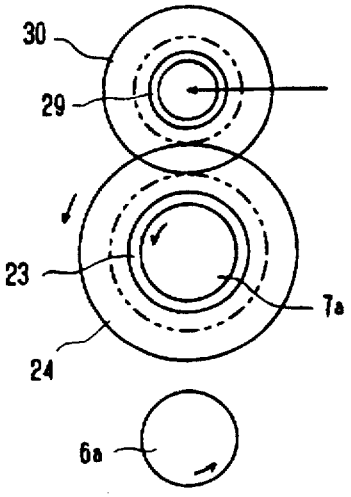
FIG. 8A is an explanatory view for gears in a meshing state through the wind operation.
Figure 8B:
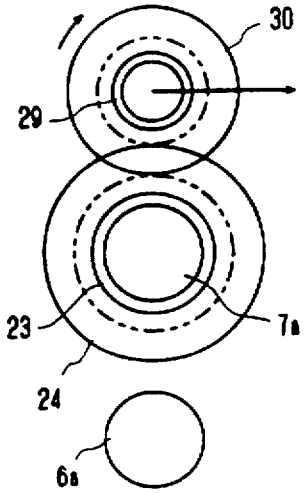
FIG. 8B is an explanatory view for gears in a released state through the wind operation.

Now, the operational sequences of the cloth wind and rewind device 20 will hereunder be explained. The shift gear 30 and the adjuster 33 in the wind procedure is set as shown in FIG. 2. When the actuator (B) is operated in response to a wind command signal in the cleaning operation, the cloth feed arm 27 is urged by the extension of the operation rod. The movement of the cloth feed arm affects the shift gear 30 to move in the arrow direction shown in FIG. 8A to rotate with the wind gear 24 in a meshing state to each other. But the rotation is prohibited by the clutch (C), so that the movement of the shift gear is transmitted to the wind gear and the second axis 7*a* is rotated via the clutch (B). When the operation rod is drawn by an actuation of the cloth feed cylinder, the shift gear 30 is made free as shown in FIG. 8B not to transmit the power to the wind gear 24. As has been mentioned above, the cleaning cloth feed from the feed roll by the predetermined length can be carried out by such one swing of the cloth feed arm to thereby wind the used cleaning cloth: to the cloth wind shaft.

Figure 9A:
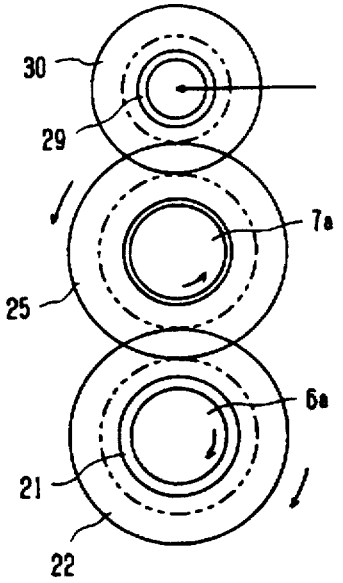
FIG. 9A is an explanatory view for gears in a meshing state through the rewind operation.

The shift gear 30 and the adjuster 33 in the rewind operation is set as shown in FIG. 3. When the cylinder (B) is operated upon a rewind command signal after the cleaning operation, the cloth feed arm 27 is urged by the extension of the operation rod. The motion of the cloth feed arm causes the shift gear 30 to shift in an arrow direction on FIG. 9A, whereby the rewind gear 22 is rotated via the intermediate gear 25. However the rotation is prevented by the clutch (C), so that the movement of the shift gear is transmitted to the rewind gear 22 via the intermediate gear 25 and rotate the first axis 6*a* via the clutch (A).

Figure 9B:
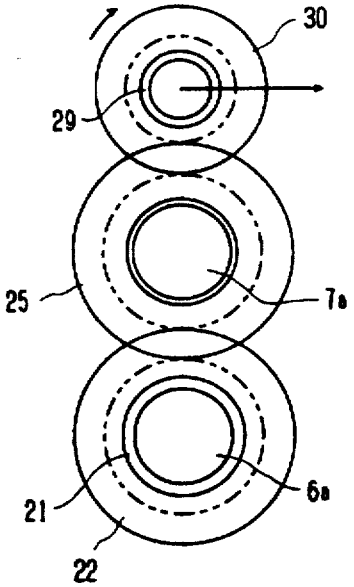
FIG. 9B is an explanatory view for gears in a released state through the rewind operation.

In the drawing operation of the operation rod when the cylinder (B) is activated, the shift gear 30 is made free as shown in FIG. 9B and the power transmission to the rewind gear 22 does not take place. The one rotation of the cloth feed arm causes to rewind the part of the used cleaning cloth wound around the cloth wind shaft to the feed roll. The rewound cleaning cloth is prepared for the next cleaning procedure.

Figure 10:
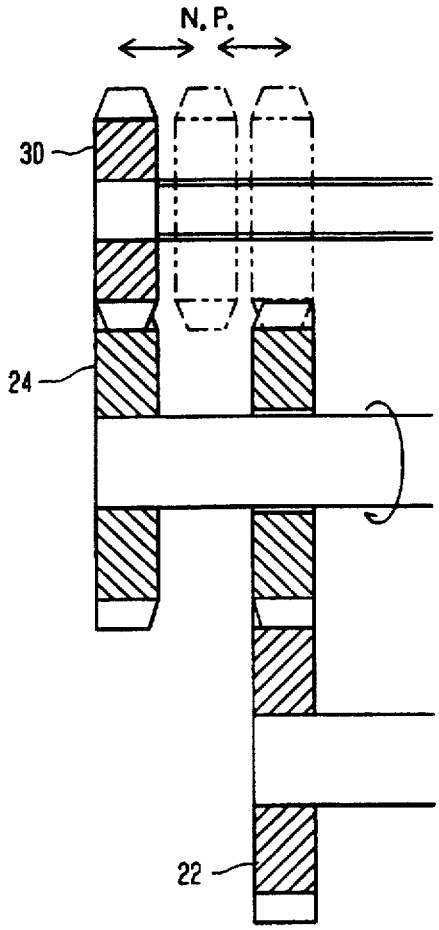
FIG. 10 is an explanatory view for a first modification of the embodiment by replacing an operation of a shift gear with another one.

In the foregoing description of the embodiment, since there are provided clutches respectively for the wind gear, rewind gear and the shift gear, but which should not be limitedly understood. The modification shown in FIG. 10 provide an another structure in which the shift gear is adapted to shift between a position meshing with the wind gear or the intermediate gear and a position being feed (=N.P.: Neutral position) The shift gear is provided to mesh with the wind or intermediate gear only when activating for the wind or rewind operation. When the cloth feed arm moves and the one operation of wind or rewind is carried out, the shift gear is placed at the N.P. and the cloth feed arm is returned from the processed position to the original place. The repeated operation provides the expected wind or rewind operation.

Figure 11:
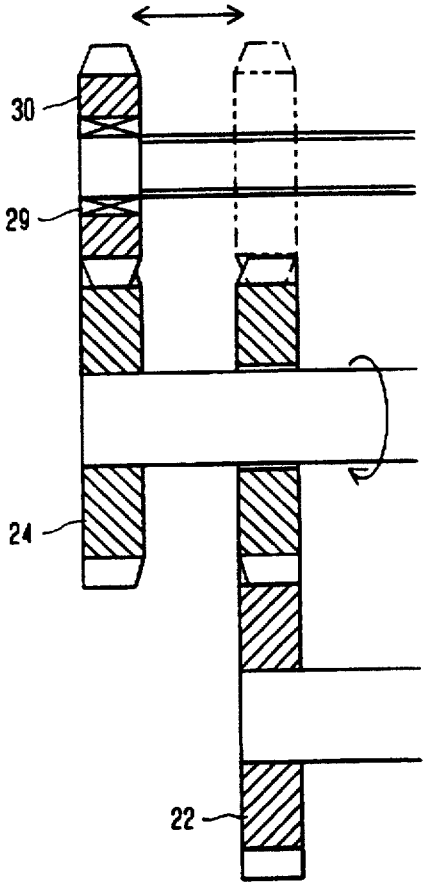
FIG. 11 is an explanatory view for a second modification of the embodiment by replacing an operation of a shift gear with another one.

Now referring to FIG. 11 showing another modification, the clutch is only provided for the shift gear, the wind or rewind operation can be carried out in a state meshing with the wind or rewind gear.

According to the present invention, the cleaning unit 1 is securely provided with reference to the cylinder to be cleaned to control an air supply into the air pad so that the cleaning cloth 2 is urged on or released from the surface of the cylinder to be cleaned. However, the present invention should not be limitedly used but can be applied on several kinds of cylinder cleaning apparatus. For example, a reciprocal type is also available, if formulating the cleaning unit to rotate about a driving shaft, in which the air pad of the cloth urging device contacts with and departs from the external surface of the cylinder so called a swing-type otherwise a forward or backward moving type cleaning unit is provided to be urged or released.

Furthermore, the present invention has been explained as a cloth urge type apparatus having a pressure pad consisting of an inflated member by an air fed thereinto, but it should not be limitedly understood. Taking for an instance, it will be also available to be organized with a cloth urge member such as a pressure pad or a pressure roller showing a solid section of an elastic member such as rubber, synthetic resin and so on so that the cleaning cloth can be contacted with or released from the cylinder.

In the embodiment, the predetermined length cloth feed mechanism is organized as one body, but it can be separately provided respectively at the second axis side and the rewind axis side in a state that they individually used.

What is claimed is:

1. A cylinder cleaning apparatus for cleaning an external surface of a cylinder of a press having a cleaning cloth which is fed from a cloth feed roll to a cloth wind shaft, the cylinder cleaning apparatus comprising:

power generation means for generating a power for rewinding the cloth feed roll and winding the cloth wind shaft, wherein said power generation means includes a cloth feed arm means for paying out a first length of cloth from the cloth feed roll and rewinding a second length of cloth from the cloth wind shaft, said cloth feed arm means rotatably mounted to the press for movement through a displacement degree; and shift means, mounted on said cloth feed arm means, for selectively transmitting said power to a one of the cloth feed roll and the cloth wind shaft.

2. A cylinder cleaning apparatus according to claim 1, wherein said power generation means comprises a first axis gear coupled to the cloth feed roll, transmitting said power to rewind the cleaning cloth, a second axis gear, coupled to the cloth wind shaft, transmitting said power to wind the cleaning cloth, and a gear transmitting means for transmitting movement of said cloth feed arm means to a one of said first axis gear and said second axis gear.

3. A cylinder cleaning apparatus according to claim 1, wherein said power generation means includes a first axis gear applying a rewind rotation power to the cloth feed roll to rewind the cleaning cloth, a second axis gear applying a wind rotation power to the cloth wind shaft to wind the cleaning cloth, and gear transmitting means for transmitting a movement of said cloth feed arm means to a one of said first axis gear and said second axis gear; and wherein said shift means includes a shift gear shaft and a wind and rewind shift gear on said shift gear shaft selectively engaging said first axis gear and said second axis gear, said shift gear shaft supported on said cloth feed arm means wherein said shift gear shaft is not rotatable but moveable in an axial direction, and a wind and rewind actuator moving said shift gear shaft between a winding position and a rewinding position.

4. A cylinder cleaning apparatus according to claim 3, wherein said shift means includes a one-way clutch means for allowing one direction power transmission between said second axis gear and the cloth wind shaft, a second one-way clutch means for allowing one direction power transmission between said first axis gear and the cloth feed roll, and a third one-way clutch means for allowing one direction power transmission between said wind and rewind shift gear and said shift gear shaft.

5. A cylinder cleaning apparatus according to claim 1, further comprising a predetermined length cloth feed means for controlling said displacement degree of said cloth feed arm means in conformity with an amount of cloth wound on the cloth wind shaft.

6. A cylinder cleaning apparatus according to claim 2, wherein said cloth feed arm means is rotatably mounted coaxially with the cloth wind shaft.

7. A cylinder cleaning apparatus according to claim 2, wherein said gear transmitting means and said second axis gear are mounted on a common shaft and said gear transmitting means is provided with an intermediate gear continuously meshing with said first axis gear.

8. A cylinder cleaning apparatus according to claim 5, wherein said predetermined length cloth feed means comprises a cloth diameter detection means for sensing a diameter of a one of the cloth feed roll and the cloth wind shaft, an arm regulation means for limiting said displacement degree of said cloth feed arm means in conformity with said cloth diameter sensed by said cloth diameter detection means, a predetermined feed control means having a wind regulation surface and a rewind regulation surface for defining said displacement degree of said cloth feed arm means, and a predetermined length shift actuator means for positioning said arm regulation means with reference to said wind regulation surface.

9. A cylinder cleaning apparatus according to claim 3, wherein said wind and rewind shift gear, said second axis gear, and said first axis gear each have tapered cut-off portions.

10. A cylinder cleaning apparatus according to claim 7, wherein said intermediate gear has tapered cut-off portions at contacting portions with said wind and rewind shift gear.

11. A cylinder cleaning apparatus for cleaning an external surface of a cylinder of a press having a cleaning cloth which is fed from a cloth feed roll to a cloth wind shaft, the cylinder cleaning apparatus comprising:

power generation means for generating a power for rewinding the cloth feed roll and winding the cloth wind shaft, wherein said power generation means includes a cloth feed arm means for paying out a first length of cloth from the cloth feed roll and rewinding a second length of cloth from the cloth wind shaft, said cloth feed arm means rotatably mounted to the press for movement through a displacement degree;

shift means for selectively transmitting said power to a one of the cloth feed roll and the cloth wind shaft; and predetermined length cloth feed means comprising a cloth diameter detection means for sensing a diameter of a one of the cloth feed roll and the cloth wind shaft, an arm regulation means for limiting said displacement degree of said cloth feed arm means in conformity with said diameter sensed by said cloth diameter detection means, a predetermined feed control means having a wind regulation surface and a rewind regulation surface for defining said displacement degree of said cloth feed arm means, and a predetermined length shift actuator means for positioning said arm regulation means with reference to said wind regulation surface.

* * * * *